United States Patent [19]

Asman

[11] Patent Number: 4,716,661

[45] Date of Patent: Jan. 5, 1988

[54] DRYER JOURNAL PROTECTION

[75] Inventor: Glen D. Asman, Port Alberni, Canada

[73] Assignee: MacMillan Bloedel Limited, Vancouver, Canada

[21] Appl. No.: 23,618

[22] Filed: Mar. 9, 1987

[51] Int. Cl.[4] ..... F26B 13/18

[52] U.S. Cl. ..... 34/125; 34/119

[58] Field of Search ..... 34/124, 125, 119; 165/89, 90

[56] References Cited

U.S. PATENT DOCUMENTS 1,715,677 6/1929 Ritchie ..... 34/125

1,948,963 2/1934 Dukes ..... 34/125

4,501,075 2/1985 Jenkner et al. ..... 34/125

*Primary Examiner*—Larry I. Schwartz

*Attorney, Agent, or Firm*—C. A. Rowley

[57] ABSTRACT

A hollow journal extending from a dryer drum is provided with an internal tube defining an angular insulating space between the inner wall of the hollow journal and the tube. This space is sealed at the inner end adjacent to dryer drum and is vented at the opposite end so that the insulating space is vented to atmosphere thereby provide a simple mounting system for mounting the fluid transfer passages through the dryer drum head and journal structure that better insulates the journal from the tube.

6 Claims, 6 Drawing Figures

FIG.1.
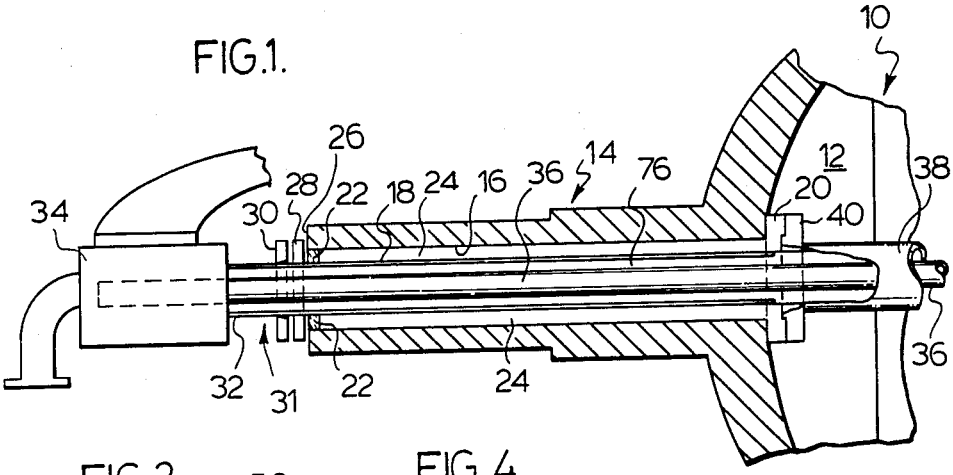
FIG.3.
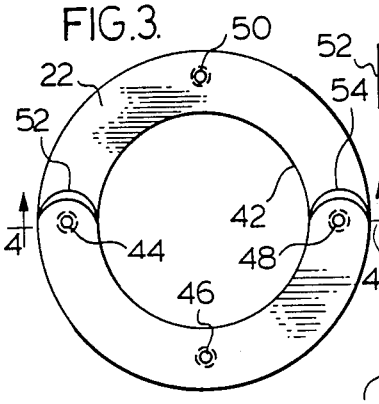
FIG.4.
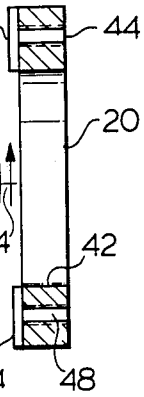
FIG.2.
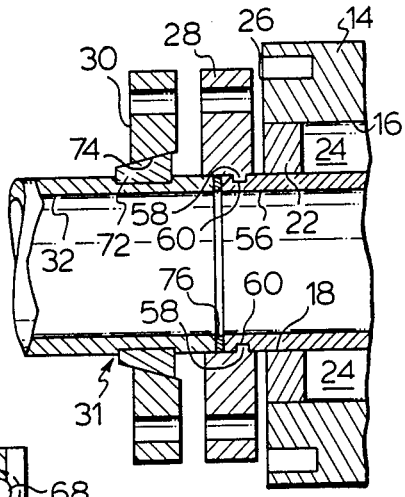
FIG.5.
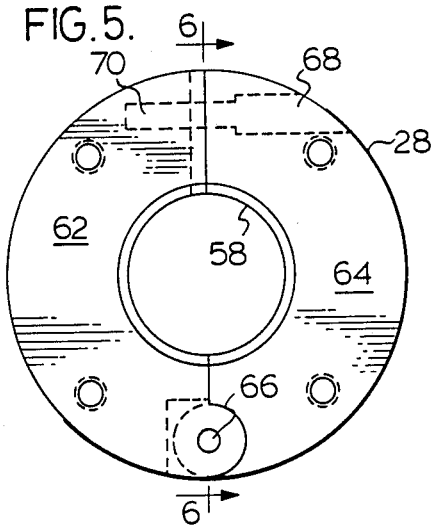
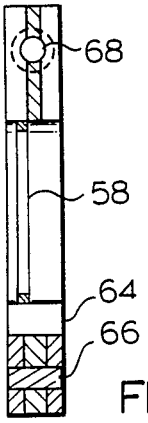
FIG.6.

DRYER JOURNAL PROTECTION

FIELD OF THE INVENTION

The present invention relates to a dryer journal structure, more particularly the present invention relates to a mounting system for a heat transfer fluid passage through a journal that is easily mounted and provides an insulating vented air space between the passage and the inner wall of the journal.

BACKGROUND OF THE INVENTION

Most manufacturers of dryer drums and steam fittings for dryer drums have their own systems for mounting the steam and condensation removal passages to and from the dryer through at least one of the mounting journals.

In a simple system the steam inlet passages is through one of the journals and the condensate removal passage passes throgh the other journal, i.e. on opposite ends of the dryer drum. It is also known to concentrically provide an air space, steam inlet tube and condensate return pipe within a single journal of the dryer drum.

It will be apparent that the steam tube and condensate return pipe rotate with the dryer drum and thus a suitable rotary coupling must be provided to connect these tubes or pipes to corresponding fixed conduits. Generally, such couplings are connected by fittings bolted directly to the outer end of the dryer journal. When concentric steam and condensate passages are used the fittings are fixed to the journal and in some manner sealed to the tube for steam passage through the journal into the dryer drum (the condensate pipe passes directly to the rotary coupling with no intermediate fitting or nipple). Such sealed connections between the fittings and steam tube are in many cases formed within the confines of the hollow journal itself.

It is common practice to maintain an air space between the inner wall of the journal, i.e. of the hollow journal and the steam tube and/or condensate return pipe passing through the journal. These annular insulating chambers are sealed at the dryer end of the journal by a suitable flange generally bolted to the head of the dryer and at the opposite end by a suitable insert which forms a part of a fitting bolted to the free end of the journal and functioning to center the tube or pipe passing through the journal and connect, in sealed relation, this tube or pipe with a fitting or nipple leading to a rotary coupling. Such sealed air spaces are intended to insulate the dryer journal from the hot steam and condensate passing therethrough, however, while a dead air space provides a good insulator the sealed space results in building up the air pressure by heating of the trapped air which reduced the effectiveness of the air space for impairing heat transfer from the tube to the journal.

BRIEF DESCRIPTION OF PRESENT INVENTION

It is an object of the present invention to provide a simple system for field installation and removal for servicing of the necessary plumbing and hardware for steam and condensate passage through a hollow dryer drum journal.

It is further object of the present invention to provide a simplified connecting means between the passages through the hollow journal and the rotary coupling connecting these passages with stationary conduits.

Broadly, the present invention relates to a dryer construction comprising a head connected to a dryer drum, a hollow journal with an axial passage having internal walls extending from said head and terminating in a free end, a tube concentric with said hollow journal and spaced from said inside wall to define an annular air space between said wall and said tube, flange means mounting said tube concentrically inside said head and sealing the end of said air space remote from said free end, spacer means spacing and centering said tube relative to said inner wall, said spacer means being located adjacent the end of said air space adjacent said free end and passage means by venting said air space to ambient air.

Preferably, said passage means will extend through said spacer.

To simplify connection of said tube with a rotary coupling, an extension of said tube preferably projects outward beyond said journal and is provided with a split flange clamped about said extension of said tube, said flange being adapted to cooperate with an aligning and coupling flange forming part of a fitting coupling the extension of said tube to a rotary coupling.

Preferably, a pipe will extend axially through the center of the tube and will project beyond said tube for connection to a suction or siphon head within said dryer and/or in the opposite direction through said fitting into said rotary coupling.

BRIEF DESCRIPTION OF DRAWINGS

Further features, objects and advantages will be evident from the following detailed description of the preferred embodiments of the present invention taken in conjunction with the accompanying drawings in which:

FIG. 1 is a partial axial section through dryer drum head and hollow journal illustrating the present invention.

FIG. 2 is an enlarged view of the free end of the journal illustrating the spacer and flange coupling between the fitting and tube.

FIG. 3 is an end view of the spacer used to space tube from the inner wall of the hollow journal adjacent to the free end of the journal.

FIG. 4 is a section along the lines 4—4 of FIG. 3.

FIG. 5 is a end view of the clamping flange forming half of the flange coupling.

FIG. 6 is a partial section along the lines 6—6 of FIG. 5.

DESCRIPTION OF THE PREFERRED EMBODIMENTS

A dryer drum generally indicated at 10 is provided with a head 12 having a hollow journal section 14 projecting laterally therefrom. The journal section 14 has a hollow passage 16 extending therethrough and adapted to receive the tubular elements for steam injection and/or condensate removal.

In the illustrated arrangement, a tube 18 extends concentrically through the passage 16 spaced from the inside walls thereof. This tube 18 is provided at its inner end, i.e. end adjacent to dryer drum 10 with a flange 20 secured in sealing relation therewith and bolted or otherwise secured to the head 12 in sealing relation therewith.

Tube 18 is supported and centered adjacent the opposite end of the journal 14, i.e. the free end 26 thereof by a spacer 22 thereby to define an angular insulating chamber 24 between the inner walls of the hollow passage 16 and the outer wall of the tube 18 and between the flange 20 and spacer 22. It can be seen that the passage 16 is a substantially right circular cylindrical as is the tube 18 so that an annular air chamber or space 24 is provided.

The tube 18 projects outward from the dryer drum beyond the free end 26 of the journal and has clamped thereto a suitable flange 28 adapted to cooperate with an aligning and coupling flange 30 mounted on a fitting 31. The fitting 31 includes extension pipe or nipple 32 for connecting to a rotary coupling 34 as will be described hereinbelow.

In the illustrated arrangement, a condensate return pipe 36 passes through the steam tube 18 and extension pipe or nipple 32 into the rotary coupling 34 and in the opposite direction from the tube 18 beyond the flange 20 into the dryer drum itself into a position to be connected to the siphon head (not shown). The end of the pipe 36 within the dryer drum 10 is supported on a suitable spider 38 which in turn is mounted on the head 12 by means of a radial flange 40 that cooperates with the flange 20 and is bolted to the flange 20 and/or head 12 or secured thereto in any suitable manner to rigidly fix the spider 38 and thereby the pipe 36 in position relative to the dryer drum. The spider 38 supports the pipe 36 while permitting passage of steam from tube 18 into the drier drum for heating same.

The space 24 is sealed at the inner end (dryer drum end) by the flange 20 and is closed off at its other end by the spacer 22. It is important that this space 24 be vented to permit the escape of heated air so that the air pressure in the space 24 does not build up significantly and thereby reduce the heat transfer from the pipe 18 to the journal 14. The spacer 22 as shown in FIG. 3 has a central axial bore 42 adapted to snugly receive the outer surface of the pipe 18 and is provided with further venting bores 44, 46, 48 and 50 providing communication between the annular insulating space 24 and the ambient air. These passages open into the space between the clamp flange 18 and the free end 26 of the journal 14. If desired, one or more of the axial holes 44, 46, 48 or 50 may be provided with scoops such as those indicated at 52 and 54 in FIGS. 3 and 4 which tend to scoop air into the chamber 24 and cause some circulation of the air. This scooped in air will obviously exit via the passages having no scoops.

Referring now to FIGS. 2, 5 and 6 it can be seen that the pipe 18 has an extension 56 projecting outward beyond the free end 26 of the journal away from the dryer drum. A split flange 28 as illustrated in FIGS. 5 and 6 is positioned around the extension 56 and is clamped thereto. This split flange 28 has an annular lip 58 adapted to be snugly received in and cooperate with an annular groove 60 formed in the extension 56 of the pipe 18. In operation, the two halves 62 and 64 of the split flange 28 are opened by pivoting on pivot 66 and then closed round the extension 56 with the rib 58 located in the groove 60. Then the two sections 62 and 63 are clamped together by a suitable bolt passing through the sections 64 and threaded into the section 62 as indicated at 70 to clamp the flange 28 to the extension 56.

The fitting 31 is provided on the pipe or nipple 32 with a suitable wedge 72 that cooperates with an internal wedge 74 formed concentrically in aligning and coupling flange 30. The flange 30 is bolted to the split flange 28 thereby to force the wedges 72 and 74 together to align the pipe or nipple 32 with the tube 18 and secure the fitting 31 on the tube 18. A suitable seal which preferably is a copper sealing gasket 76 is interposed between the adjacent ends of the extension pipe or nipple 32 and extension 56 of tube 18. In this manner the fitting 31 is secured in centered, sealed relationship with the tube 18.

It will be apparent that the above arrangement is easily mounted or dismantled for maintenance purposes and provides a structure wherein an insulating space is provided between the tube 18 and the inner walls 16 of the hollowed journal 14 that is vented to the atmosphere through the ports 44, 46, 48 and 50 so that the pressure within the chamber 24 does not exceed atmospheric.

To assemble the structure of the present invention one need only climb inside of the dryer drum 10 via a suitable hatch (not shown), position the tube 18 through the passage 16 supporting it at its outer end in the spacer 22 and bolt the flange 20 to the wall or header 12 with a suitable gasket therebetween to seal the end of the passage 24 adjacent to dryer drum 10. Next, the pipe 36 is past through the tube 18 and the spider 38 extending therearound is secured by bolting the flange 40 to the flange 20 and/or head 12. If desired, the pipe 36 may be inserted through this spider 38 after the spider has been mounted in position. The pipe 36 extends through the spider 38, tube 18 and extension 32 of fitting 31 into the rotary coupling 34 which is mounted on the tube 18 via the fitting 31. If desired, the pipe 36 may form part of the rotary coupling 34 and may be mounted when the flanges 28 and 30 are clamped together. In this case the opposite end is then positioned in axial alignment within the tube 18 via the spider 38. A suitable siphon (not shown) is bolted to the end of the pipe 36 within dryer 10 by any suitable means such as a pair of mating radial flanges. If a radial flange for this purpose is permanently secured to the pipe 36, the pipe 36 must be fed through the tube 18 from the dryer side toward the fitting 31.

As above indicatd it will be apparent that the flange 28 is secured to the extension 56 after the tube 18 is in position through the journal 14 and then the nipple 31 carrying the rotary fitting 34 is secured by bolting the aligning and coupling flange 30 to the flange 28 to secure the extension 32 in aligned sealing relationship with the end of the pipe 18.

In the described arrangement, condensate will be removed via the pipe 36 and steam injected into the dryer drum through the annular passage 76 (FIG. 1) between the outer wall of pipe 36 and the inner wall surfaces of extension or nipple 32 and tube 18 and the passage formed around the pipe 36 through the spider 38.

It is an easy matter to disassemble the unit for maintance or rapair by uncoupling the flanges 28 and 30 and then (assuming the pipe 36 is not fixed to the rotary coupling 34) removing the rotary coupling 34. It is then only necessary for one to enter the drier drum 10 through the hatch (not shown), unfasten the bolts holding the spider 38 to the head and/or flange 20 to permit withdrawal of pipe 36 (assuming the syphon has been disconnected). Thereafter the bolt holding the flange 20 to the head may be disconnected and the tube 18 drawn into the drum 10 for removal. If the tube 18 is not to be withdrawn and the pipe 36 is not fixed to the rotary coupling 34 the flanges 28 and 30 need not be uncoupled to remove the the pipe 36.

Having described the invention modifications may be made without departing from the spirit of the invention as defined in the appended claims.

I claim:

1. A dryer construction comprising a head for a dryer drum, a hollow journal projecting from said head and terminating at a free outer end, said hollow journal having an axially extending passage having an inside wall, a tube concentrically positioned within said hollow journal and spaced from said inside wall to define an annular insulating space between said tube and said inside wall, radial flange means extending from said tube means, securing means securing said flange to said head to secure said tube in centered concentric relationship in said journal and seal the end of said space remote from said free end, spacer means spacing and centering said tube relative to said inner wall at the end of said space remote from said flange and adjacent said free end, said space extending substantially the full axial length of said journal and being sealed with the exception of a venting passage means continuously venting said space to atmosphere.

2. A dryer construction as defined in claim 1 wherein said passage means extend in an axial direction through said spacer means to vent said space to atmosphere.

3. A dryer construction as defined in claim 2 further comprising scoop means adjacent the outer end of at least some of said passage means to scoop outside air into said space as said spacer means rotates with said journal.

4. A dryer construction as defined in claim 1 wherein said tube has an extension extending outwardly beyond said spacer means and said free outer end and is provided with a split flange clamped therearound, a fitting, an aligning and coupling flange on said fitting, means connecting said split flange to said aligning flange to secure said fitting in aligned relation on said extension.

5. A structure as defined in claim 1 further comprising a return pipe for condensate extending concentrically and axially through said tube, a spider supporting the end of said pipe adjacent said radial flange, said spider being secured to said radial flange to mount said pipe and position same concentrically in said tube.

6. A structure as defined in claim 4 further comprising a return pipe for condensate extending concentrically and axially through said tube, a spider supporting the end of said pipe adjacent said radial flange, said spider being secured to said radial flange to mount said pipe and position same concentrically in said tube.

* * * * *